US005656927A

United States Patent [19]

Wilhelm et al.

[11] Patent Number: 5,656,927

[45] Date of Patent: Aug. 12, 1997

[54] CIRCUIT ARRANGEMENT FOR GENERATING A BIAS POTENTIAL

[75] Inventors: Wilhelm Wilhelm, Munich; Josef Hoelzle, Bad Woerishofen, both of Germany

[73] Assignee: Siemens Aktiengesellschaft, Munich, Germany

[21] Appl. No.: 721,562

[22] Filed: Sep. 26, 1996

[30] Foreign Application Priority Data

Sep. 26, 1995 [DE] Germany ..... 195 35 807.4

[51] Int. Cl.[6] ..... G05F 3/04; G05F 3/16

[52] U.S. Cl. ..... 323/313; 323/314

[58] Field of Search ..... 323/311, 312, 323/313, 314, 315, 316, 317

[56] References Cited

U.S. PATENT DOCUMENTS

| | | | |
|---|---|---|---|
| 5,168,210 | 12/1992 | Thus | 323/313 |
| 5,208,527 | 5/1993 | Poletto et al. | 323/313 |
| 5,258,703 | 11/1993 | Pham et al. | 323/313 |
| 5,325,045 | 6/1994 | Sundby | 323/314 |
| 5,352,973 | 10/1994 | Audy | 323/313 |
| 5,410,241 | 4/1995 | Cecil | 323/314 |
| 5,424,628 | 6/1995 | Nguyen | 323/314 |
| 5,530,340 | 6/1996 | Hayakawa et al. | 323/314 |

*Primary Examiner*—Peter S. Wong
*Assistant Examiner*—Bao Q. Vu
*Attorney, Agent, or Firm*—Herbert L. Lerner; Laurence A. Greenberg

[57] ABSTRACT

Circuit arrangement for generating a bias potential includes a first transistor connected on a collector side thereof to a supply potential, a first resistor connected between a base and the collector of the first transistor, a first current source connected between the base of the first transistor and a reference potential, a second current source connected between an emitter of the first transistor and the reference potential, a second transistor connected on a collector side thereof to the supply potential and on a base side thereof to the emitter of the first transistor, a third current source connected between the emitter of the second transistor and the reference potential, a third transistor carrying the bias potential on a collector side thereof, a second resistor connected between the emitter of the second transistor and a base of the third transistor, a third resistor connected between the collector of the third transistor and the supply potential, a first diode connected in the forward direction thereof between the base of the third transistor and the reference potential, and a fourth resistor connected between an emitter of the third transistor and the reference potential, the second and the third resistors having equal resistances and the fourth resistor having half the resistance of the second and the third resistors, respectively, and second and third current sources supplying a current which is dependent upon a collector current of the third transistor.

7 Claims, 2 Drawing Sheets

CIRCUIT ARRANGEMENT FOR GENERATING A BIAS POTENTIAL

BACKGROUND OF THE INVENTION

Field of the Invention

The invention relates to a circuit arrangement for generating a bias potential.

Heretofore, supply voltages for integrated logic circuits were usually in the range of about 5 V. Thus CMOS circuits and TTL circuits, for example, require 5.0 V, while ECL circuits require either 4.5 or 5.2 V. Modern CMOS components, conversely, require only 3.3 V as a supply voltage and, in the future, will replace the earlier circuits having a supply voltage of 5 V. It is therefore desirable for future bipolar circuits also to be operable at a supply voltage of 3.3 V. It would be even more favorable if the bipolar circuits were usable in a voltage range from 3 to 6 V, for example, without any change in wiring, because the circuit can then be connected to any available voltage source.

To that end, bias potentials are necessary for preventing the supply voltage from having any influence upon the function of the circuit. The bias potentials should also be generated by bipolar circuitry or circuit technology with a view to their use in a bipolar circuit. With a bias potential thus independent of the supply voltage, both digital and analog circuits can be realized, which can be operated with both higher and lower supply voltages.

SUMMARY OF THE INVENTION

It is accordingly an object of the invention to provide a circuit arrangement for generating a bias potential independent of the supply voltage, which can also be operated at low supply voltages.

With the foregoing and other objects in view, there is provided, in accordance with the invention, a circuit arrangement for generating a bias potential, comprising a first transistor connected on a collector side thereof to a supply potential, a first resistor connected between a base and the collector of the first transistor, a first current source connected between the base of the first transistor and a reference potential, a second current source connected between an emitter of the first transistor and the reference potential, a second transistor connected on a collector side thereof to the supply potential and on a base side thereof to the emitter of the first transistor, a third current source connected between the emitter of the second transistor and the reference potential, a third transistor carrying the bias potential on a collector side thereof, a second resistor connected between the emitter of the second transistor and a base of the third transistor, a third resistor connected between the collector of the third transistor and the supply potential, a first diode connected in the forward direction thereof between the base of the third transistor and the reference potential, and a fourth resistor connected between an emitter of the third transistor and the reference potential, the second and the third resistors having equal resistances and the fourth resistor having half the resistance of the second and the third resistors, respectively, and second and third current sources supplying a current which is dependent upon a collector current of the third transistor.

In accordance with another feature of the invention, the third transistor has a further emitter which is connected to the reference potential via a respective fifth resistor, and the second, third, fourth and fifth resistors, respectively, have equal resistances.

In accordance with a further feature of the invention, the second current source has a fourth transistor connected on an emitter side thereof to the reference potential and on a collector side thereof to the emitter of the first transistor, a fifth transistor connected on a collector side thereof to the supply potential and on an emitter side thereof to a base of the fourth transistor, a sixth transistor connected on an emitter side thereof to the reference potential and on a collector side thereof to the base of the fourth transistor, two second diodes (17, 18) connected in a forward direction thereof serially between a base of the fifth transistor and the reference potential, and a sixth resistor connected between the base of the fifth transistor and an auxiliary potential, and a base of the sixth transistor is connected to a terminal of the first diode remote from the reference potential.

In accordance with an added feature of the invention, the third current source has a seventh transistor connected on an emitter side thereof to the reference potential, a third diode connected in a forward direction thereof between a collector and the emitter of the seventh transistor, a seventh resistor connected between the auxiliary potential and the collector of said seventh transistor, an eighth transistor connected on an emitter side thereof to the reference potential and on a base side thereof to the collector of the seventh transistor, and the base of the seventh transistor is connected to the terminal of the first diode remote from the reference potential, and a collector of the eighth transistor is connected to the emitter of the second transistor.

In accordance with an additional feature of the invention, the auxiliary potential is able to be picked up at an emitter of a ninth transistor having a collector which is connected to the supply potential and having a base which is connected to the collector of the third transistor.

In accordance with yet another feature of the invention, the first current source is formed as a bandgap current source.

In accordance with a concomitant feature of the invention, the circuit arrangement includes another resistor having a resistance equal to that of the second and third resistor, respectively, and being connected between the first diode and the base of the third transistor.

Other features which are considered as characteristic for the invention are set forth in the appended claims.

Although the invention is illustrated and described herein as embodied in a circuit arrangement for generating a bias potential, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
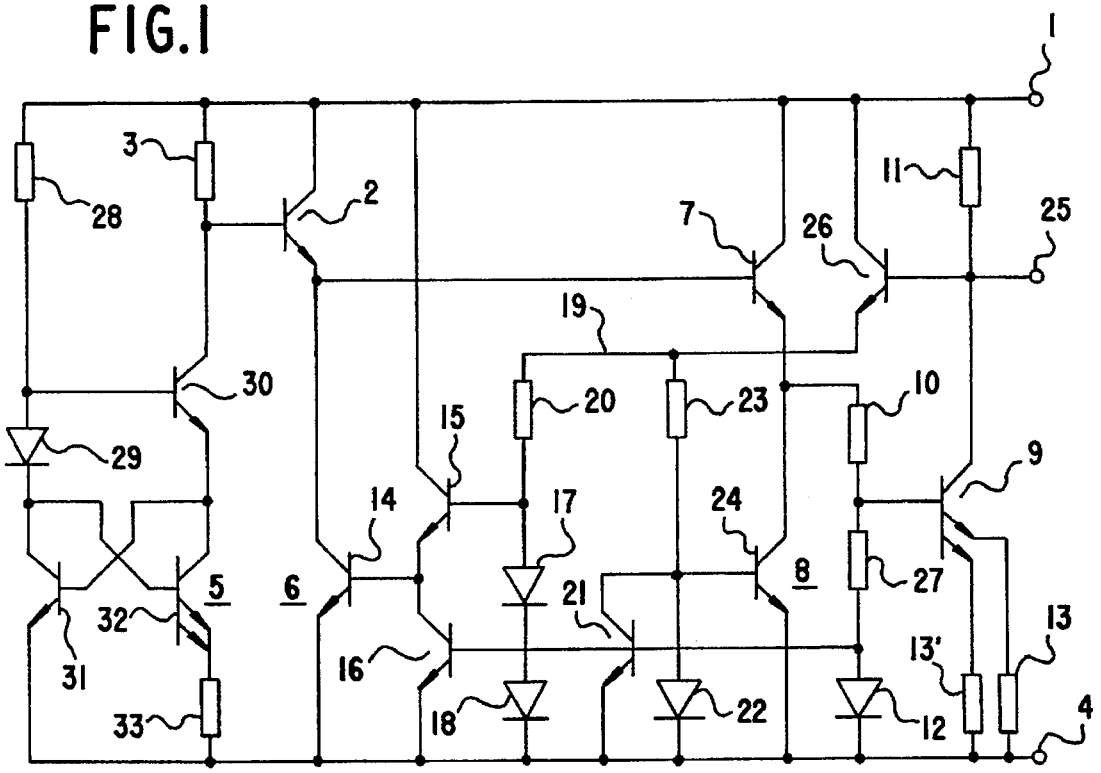
FIG. 1 is a circuit diagram of an exemplary embodiment according to the invention.

Referring now to the drawings and, first, particularly to FIG. 1 thereof, there is shown therein a circuit arrangement according to the invention, wherein a transistor 2 is provided, having a collector which is connected to a supply potential 1. A resistor 3 is connected between the base and the collector of the transistor 2. The base of the transistor 2 is also connected to a reference potential 4 via a current source 5. A current source 6 is connected between the emitter of the transistor 2 and the reference potential 4. A transistor 7 has a collector which is connected to the supply potential 1 and, on the base side the transistor 7 is connected to the emitter of the transistor 2. The emitter of the transistor 7 is connected to the reference potential 4 via a current source 8. Also provided is a transistor 9 having a base which is connected to the emitter of the transistor 7 via a resistor 10, and having a collector which is connected to the supply potential 1 via a resistor 11. The base of the transistor 9 is also connected to the reference potential 4, both via a resistor 27 and via a diode 12 in the forward direction serially connected therewith. The transistor 9 has two emitters, which are connected to the reference potential 4 via respective resistors 13 and 13'. All of the resistors 10, 11, 13, 13' and 27 have like resistance. Alternatively, the two resistors 13 and 13' can be replaced by a single resistor with half the resistance, if the transistor 9 has only one emitter. However, the embodiment having the two emitters and the appertaining resistors is more favorable with regard to variation between one version and another. In that construction, all of the resistors 10, 11, 13 and 13' have a like resistance, a feature which can be achieved in a considerably simpler manner and quite accurately in integrated circuitry than can specific resistance ratios. The resistor 27 may have the same resistance as well, but under some circumstances it may also be varied to adapt the diode 12 to the base-to-emitter path of the transistor 9, and optionally may be omitted entirely.

In a further feature of the invention, a current source 6, which delivers a current dependent upon the supply voltage appearing between the reference potential 4 and the supply potential 1, has a transistor 14 with an emitter connected to the reference potential 4, and a collector connected to the emitter of the transistor 2. Also connected to the base of the transistor 14 is, first, an emitter of a transistor 15 having a collector which is connected to the supply potential 1 and, second, a collector of a transistor 16 having an emitter which is connected to the reference potential 4. The base of the transistor 15 is coupled, on the one hand, to the reference potential 4 via a series circuit of two diodes 17 and 18 in the forward direction and, on the other hand, to an auxiliary potential 19 via a resistor 20. Finally, the base of the transistor 16 is connected to a terminal of the diode 12 which is remote from the reference potential 4.

Like the current source 6, the current source 8 is also dependent upon the supply voltage, although in a different way. The current source 8, in a further feature of the invention, includes a transistor 21, wherein a diode 22 is connected in forward direction between the collector and the emitter, the emitter of the transistor 21 being connected to the reference potential 4, and the collector thereof being connected, with the interposition of a resistor 23, to the auxiliary potential 19. Also connected to the collector of the transistor 21 is the base of a transistor 24, which has an emitter connected to the reference potential 4, and a collector connected to the emitter of the transistor 7. In the a manner similar to that for the base of the transistor 16, the base of the transistor 21 is connected to the terminal of the diode 12 remote from the reference potential 4.

A transistor 26 is provided for generating the auxiliary potential 19, which may be picked up at the emitter thereof. The base of the transistor 26, the collector of which is connected to the supply potential 1, is connected to the collector of the transistor 9, the latter collector carrying a bias potential 25.

The current source 5 is preferably formed as a band gap current source. In the exemplary embodiment, it includes a transistor 31 having an emitter which is connected to the reference potential 4, and having a collector which is connected, with the interposition of a diode 29 in the forward direction, to the base of a transistor 30. The base of the transistor 30, which has a collector connected to the base of the transistor 2, is also connected to the supply potential 1 via a resistor 28. The emitter of the transistor 30 is connected to the collector of a transistor 32 which has a plurality of mutually coupled emitters, for example, two emitters as shown in FIG. 1, the two mutually coupled emitters of the transistor 32 being connected to the reference potential 4 via a resistor 33. The bases of the transistors 31 and 32 are each connected to the respective collector of the other transistor.

To generate a bias potential 25 which is independent of the supply voltage, in accordance with the invention, a current which is supposed to supply the resistor 11 connected to the supply potential 1 and which is dependent upon a difference between the supply potential 1 and the desired bias potential 25 is formed,. The value I of this current, which is dictated by the collector current of the transistor 9, results from the value V of the supply potential 1 and the desired value U of the bias potential 25 for a resistance R of the resistor 11, as follows:

$$I=(V-U)/R$$

The desired value U for the bias potential 25 is within a range of about 3 V, for example. The current source 5 provided in the form of a bandgap current source, furnishes a current with a positive temperature response. As a result, together with the base-to-emitter path of the transistor 2, a temperature-independent bandgap voltage of approximately 1.2 V develops between the supply potential 1 and the emitter of the transistor 2. The succeeding transistors 7 and 9 add two base-to-emitter paths of approximately 0.9 V thereto, so that approximately 3 V are attained. However, because the transistors 7 and 9 carry a different collector current, depending upon the supply voltage, the effect of the supply voltage on these currents must consequently yet be eliminated. The desired value U of the bias potential is derived from the value $I_5$ of the current source 5, the resistance $R_3$ of the resistor 3, the thermal voltage $U_T$, the value $I_6$ of the current output from the current source 6, the value $I_8$ of the current output from the current source 8, the value $I_S$ of the transistor blocking current, as well as the value I of the collector current of the transistor 9, which is provided as the output current:

$$U = I_5R_3 + U_T \ln \frac{I_6(I_8 + I/2) \cdot I}{2I_S^3} .$$

For a constant value $I_6$ and a value $I_8$=0, the value I is dependent upon the value V and thus upon the value U as well.

If $$I_6=2I_K^2/I$$

and $$I_8=I_K-I/2$$

wherein $I_K$ is a constant value, then $$U=I_5R_3+3U_T\ln(I_K/I_S)$$

and is thus independent of the value V.

Figure 2:
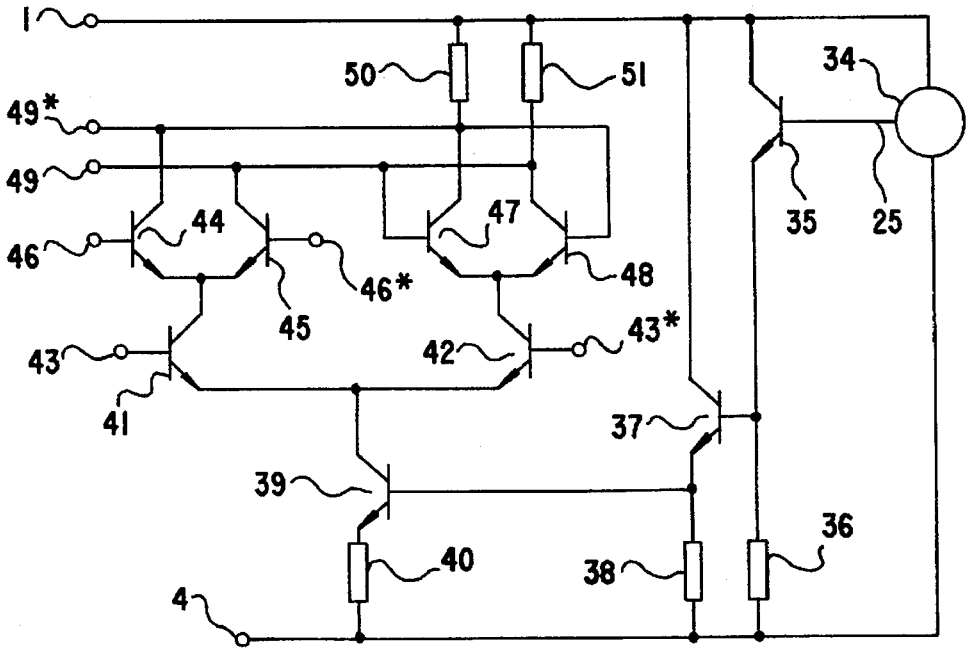
FIG. 2 is a circuit diagram of the embodiment of FIG. 1 in a logic circuit.

The use of a circuit arrangement according to the invention in a logic circuit, especially a memory or storage element, is shown in FIG. 2. The bias potential 25 generated by the circuit arrangement 34 of FIG. 1 is applied to the base of a transistor 35, the collector of which is connected to the supply potential 1 and the emitter of which is connected, with the interposition of a resistor 36, to the reference potential 4. Connected to the emitter of the transistor 35 is the base of a transistor 37, the collector of which is connected to the supply potential 1 and the emitter of which is connected via a resistor 38 to the reference potential 4. A voltage drop which is equal to the voltage between the collector and the emitter of the transistor 2 of FIG. 1 occurs at the resistor 38. Connected to the emitter of the transistor 37 is the base of a transistor 39 having an emitter which is coupled to the reference potential 4 with the interposition of a resistor 40. The collector of the transistor 39 is connected to respective emitters of two transistors 41 and 42, to respective bases of which a clock signal 43 and an inverted clock signal 43* are applied. The collector of the transistor 41 is connected to respective emitters of two transistors 44 and 45, to respective bases of which a data signal 46 and an inverted data signal 46* are applied. The collector of the transistor 42 is connected in a similar manner to respective emitters of two transistors 47 and 48, the base of the transistor 47 being connected to the collector of the transistor 45, and the base of the transistor 48 being connected to the collector of the transistor 44. Moreover, the collectors of the transistors 44 and 47 are coupled to one another, carrying an inverted output signal 49* and, with the interposition of a resistor 50, are coupled to the supply potential 1. The respective collectors of the transistors 45 and 48 are also connected to one another, carrying an output signal 49, and are connected via a resistor 51 to the supply potential 1.

Figure 3:
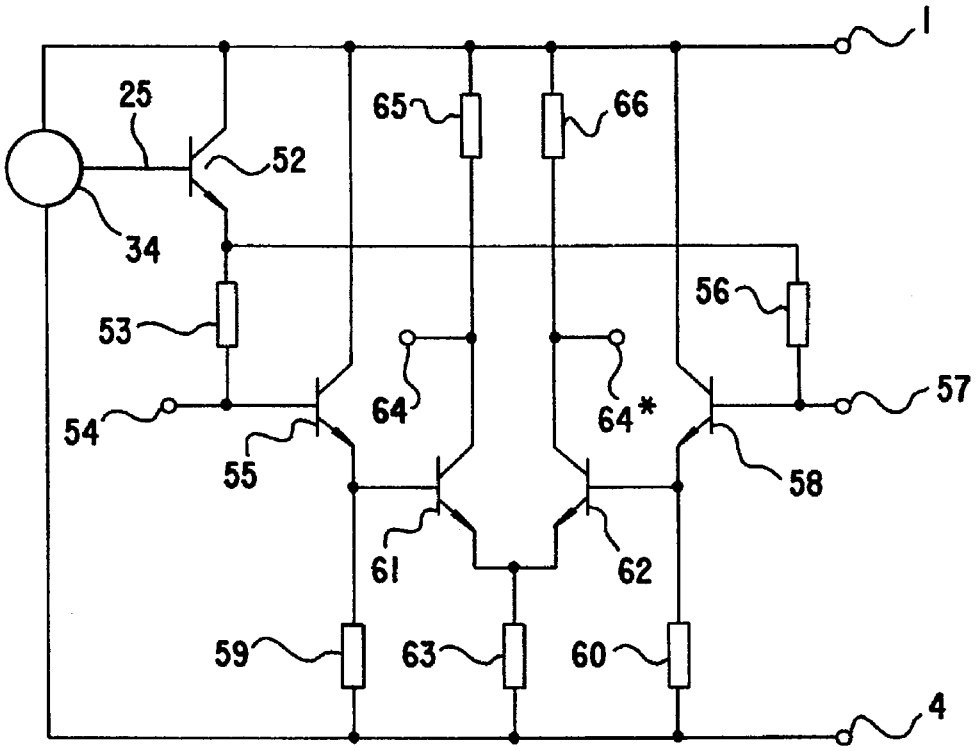
FIG. 3 is a circuit diagram of the embodiment of FIG. 1 in a driver circuit.

The application of the circuit arrangement 34 of the invention from FIG. 1 in a driver circuit is illustrated in FIG. 3. The bias potential 25 generated by the circuit arrangement 34 is applied to the base of a transistor 52 having a collector which is connected to the supply potential 1. The emitter of the transistor 52 is connected, on the one hand, via a resistor 53, to a base, which forms a signal input 54, of a transistor 55 and, on the other hand, via a resistor 56, to a base, which forms an inverting signal input 57, of a transistor 58. The respective emitters of the transistors 55 and 58, the respective collectors of which are connected to the supply potential 1, are coupled to the reference potential 4, each with the interposition of a respective resistor 59 and 60. Connected to the emitters of the transistors 55 and 58 are respective bases of transistors 61 and 62, which have emitters coupled to one another and, via a resistor 63, to the reference potential 4. The respective collectors of the transistors 61 and 62, carrying an output signal 64 and an inverting output signal 64*, respectively, are connected to the supply potential 1 via respective resistors 65 and 66.

Figure 4:
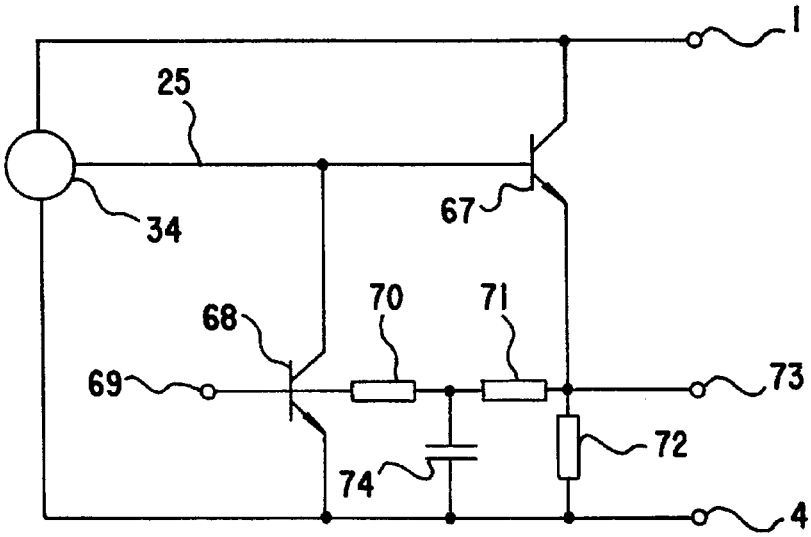
FIG. 4 is a circuit diagram of the embodiment of FIG. 1 in an amplifier circuit.

FIG. 4 shows the application of a circuit arrangement 34 of the invention in a linear amplifier. The bias potential 25 generated by the circuit arrangement 34 is supplied both to the base of a transistor 67 and the collector of a transistor 68. The base of the transistor 68, the emitter of which is connected to the reference potential 4, forms a signal input 69. For the purpose of regenerative or feedback coupling, the base of the transistor 68 is also coupled via a series circuit of two resistors 70 and 71 to the emitter of the transistor 67, which is connected on the collector side thereof to the supply potential 1. A pickup between the two resistors 70 and 71 is conducted via a capacitor 74 to the reference potential 4. Finally, a resistor 72 is connected between an emitter forming an output 73 of the transistor 67 and the reference potential 4. The gain of the amplifier circuit results from the ratio of the voltage dropping across the load path of the transistor 2 in FIG. 1 to the thermal voltage.

Both in the exemplary embodiment of FIG. 1 and in the exemplary applications of FIGS. 2 to 4, only npn transistors are used, so that, in this case, the supply potential 1 is positive and the reference potential 4 is negative. An embodiment with only pnp transistors, or a mixed embodiment with both npn and pnp transistors, however, is equally possible. The illustrated circuits operate within a voltage range of from 3 V to 6 V and have constant characteristics or properties.

We claim:

1. Circuit arrangement for generating a bias potential, comprising a first transistor connected on a collector side thereof to a supply potential, a first resistor connected between a base and the collector of said first transistor, a first current source connected between said base of said first transistor and a reference potential, a second current source connected between an emitter of said first transistor and said reference potential, a second transistor connected on a collector side thereof to said supply potential and on a base side thereof to said emitter of said first transistor, a third current source connected between said emitter of said second transistor and said reference potential, a third transistor carrying said bias potential on a collector side thereof, a second resistor connected between said emitter of said second transistor and a base of said third transistor, a third resistor connected between the collector of said third transistor and said supply potential, a first diode connected in the forward direction thereof between said base of said third transistor and said reference potential, and a fourth resistor connected between an emitter of said third transistor and said reference potential, said second and said third resistors having equal resistances and said fourth resistor having half the resistance of said second and said third resistors, respectively, and second and third current sources supplying a current which is dependent upon a collector current of said third transistor.

2. Circuit arrangement according to claim 1, wherein said third transistor has a further emitter which is connected to said reference potential via a respective fifth resistor, and said second, third, fourth and fifth resistors, respectively, have equal resistances.

3. Circuit arrangement according to claim 2, wherein said second current source has a fourth transistor connected on an emitter side thereof to said reference potential and on a collector side thereof to said emitter of said first transistor, a fifth transistor connected on a collector side thereof to said supply potential and on an emitter side thereof to a base of said fourth transistor, a sixth transistor connected on an emitter side thereof to said reference potential and on a collector side thereof to said base of said fourth transistor, two second diodes connected in a forward direction thereof serially between a base of said fifth transistor and said reference potential, and a sixth resistor connected between said base of said fifth transistor and an auxiliary potential, and a base of said sixth transistor is connected to a terminal of said first diode remote from said reference potential.

4. Circuit arrangement according to claim 3, wherein said third current source has a seventh transistor connected on an emitter side thereof to said reference potential, a third diode connected in a forward direction thereof between a collector and the emitter of said seventh transistor, a seventh resistor connected between said auxiliary potential and said collector of said seventh transistor, an eighth transistor connected on an emitter side thereof to said reference potential and on a base side thereof to said collector of said seventh transistor, and said base of said the seventh transistor is connected to said terminal of said first diode remote from said reference potential, and a collector of said eighth transistor is connected to said emitter of said second transistor.

5. Circuit arrangement according to claim 3, wherein said auxiliary potential is able to be picked up at an emitter of a ninth transistor having a collector which is connected to said supply potential (1) and having a base which is connected to said collector of said third transistor.

6. Circuit arrangement according to claim 1, wherein said first current source is formed as a bandgap current source.

7. Circuit arrangement according to claim 1, including another resistor having a resistance equal to that of said second and third resistors, respectively, and being connected between said first diode and said base of said third transistor.

* * * * *